US007466287B1

(12) United States Patent
Lam et al.

(10) Patent No.: US 7,466,287 B1
(45) Date of Patent: Dec. 16, 2008

(54) SPARSE TRIFILAR ARRAY ANTENNA

(75) Inventors: Lawrence K. Lam, San Jose, CA (US); Albert T. Ngo, San Jose, CA (US); Mohamed S. Mahmoud, Sunnyvale, CA (US); Marc L. Peloquin, San Jose, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 360 days.

(21) Appl. No.: 11/358,044

(22) Filed: Feb. 22, 2006

(51) Int. Cl.
*H01Q 1/36* (2006.01)

(52) U.S. Cl. ..... 343/895; 343/700 MS

(58) Field of Classification Search ..... 343/895, 343/893, 700 MS
See application file for complete search history.

(56) References Cited

U.S. PATENT DOCUMENTS

| | | | | |
|---|---|---|---|---|
| 6,778,148 | B1 * | 8/2004 | Pack | 343/895 |
| 7,173,972 | B2 * | 2/2007 | Thomson et al. | 375/260 |
| 2003/0076274 | A1 * | 4/2003 | Phelan et al. | 343/895 |
| 2003/0201948 | A1 * | 10/2003 | Phelan et al. | 343/895 |
| 2007/0063898 | A1 * | 3/2007 | Phelan et al. | 343/700 MS |

* cited by examiner

*Primary Examiner*—HoangAnh T Le
(74) *Attorney, Agent, or Firm*—McDermott Will & Emery LLP

(57) ABSTRACT

An array antenna is arranged in an innovative sparse trifilar configuration. The antenna elements forming the array antenna are arranged to form three non-linear arrays. The antenna elements are approximately aligned to a triangular lattice structure with the antenna elements of each non-linear array occupying adjacent lattice positions. The three non-linear arrays are separated from each other by vacant lattice positions, thereby making the configuration a sparse array.

23 Claims, 5 Drawing Sheets

SPARSE TRIFILAR ARRAY ANTENNA

STATEMENT REGARDING FEDERALLY SPONSORED RESEARCH OR DEVELOPMENT

Not applicable.

FIELD OF THE INVENTION

The present invention concerns electronically scanned array antennas, and, in particular, an electronically scanned array antenna having a trifilar configuration.

BACKGROUND OF THE INVENTION

Electronically scanned array antennas are commonly used in air, space and ground communication systems. These array antennas comprise multiple antenna elements whose radiation patterns are constructively combined to form antenna beams. By controlling the phase and/or amplitude of the signal fed to the individual antenna elements, the generated antenna beams are electronically shaped and scanned in a desired direction. Because the antenna beam is controlled electronically, these array antennas require minimal mechanical structure and moving parts, and are preferred for use on satellite communication systems.

The radiation pattern of an array antenna is the product of the array pattern and the radiation pattern of the individual antenna elements in the array. Desired radiation pattern characteristics, such as high directivity, low side lobes, and the absence of grating lobes, are sought after by modifying the array pattern and/or the individual antenna elements. For example, the directivity of an array antenna can be increased by increasing the aperture size of the array antenna. If a sparse array is used to obtain the larger aperture size, however, grating lobes can be generated in the radiation pattern thereby reducing the directivity of the array antenna.

Another desirable feature of array antennas is the ability to operate in multiple frequency bands and/or transmit multiple signals. For example, transmission array antennas are often required to transmit two different signals. Conventional array antennas often meet this requirement by using antenna elements designed to radiate both signals. However, when both signals pass through a non-linear circuit within the array antenna, intermodulation products from third order mixing can cause spurious signals to appear in or near the pass-bands associated with the intended transmission signals.

Accordingly, a need exists for array antenna designs that generate desirable radiation patterns. The array antenna designs should be robust enough to handle multiple signals in multiple frequency bands. The array antenna designs should also allow lightweight, thin-profile implementations having relatively low costs.

SUMMARY OF THE INVENTION

The present invention addresses the foregoing concerns by providing an array antenna having an innovative sparse trifilar configuration. The antenna elements are arranged in three non-linear arrays that are separated from each other by vacant positions in the configuration. This sparse configuration uses one half of the number of antenna elements required to fully populate a conventional array, while maintaining approximately the same directivity and beamwidth. The inventive arrangement of arranging array elements in a sparse trifilar array configuration reduces the symmetry of larger arrays comprising multiple sparse trifilar arrays. The inventive arrangement also minimizes grating lobes in the radiation pattern of the larger array antennas.

According to one aspect of the invention, a trifilar array antenna is provided having multiple antenna elements arranged in three non-linear arrays. The antenna elements are aligned to a lattice structure with the antenna elements of each non-linear array being arranged in adjacent lattice positions. The three non-linear arrays are separated from each other by vacant lattice positions.

According to another aspect of the invention, an array antenna is provided having two groups of antenna elements. A first group of antenna elements is arranged in a first group of three non-linear arrays. A second group of antenna elements is arranged in a second group of three non-linear arrays. All of the antenna elements are aligned to a lattice structure with the antenna elements of each non-linear array being arranged in adjacent lattice positions. The first group of non-linear arrays is arranged to occupy lattice positions between the second group of non-linear arrays.

The foregoing summary of the invention has been provided so that the nature of the invention can be understood quickly. A more detailed and complete understanding of the preferred embodiments of the invention can be obtained by reference to the following detailed description of the invention together with the associated drawings.

BRIEF DESCRIPTION OF THE DRAWINGS

The following detailed description of the embodiments of the present invention can best be understood when read in conjunction with the following drawings, in which the features are not necessarily drawn to scale but rather are drawn as to best illustrate the pertinent features.

DETAILED DESCRIPTION OF THE INVENTION

Figure 1:
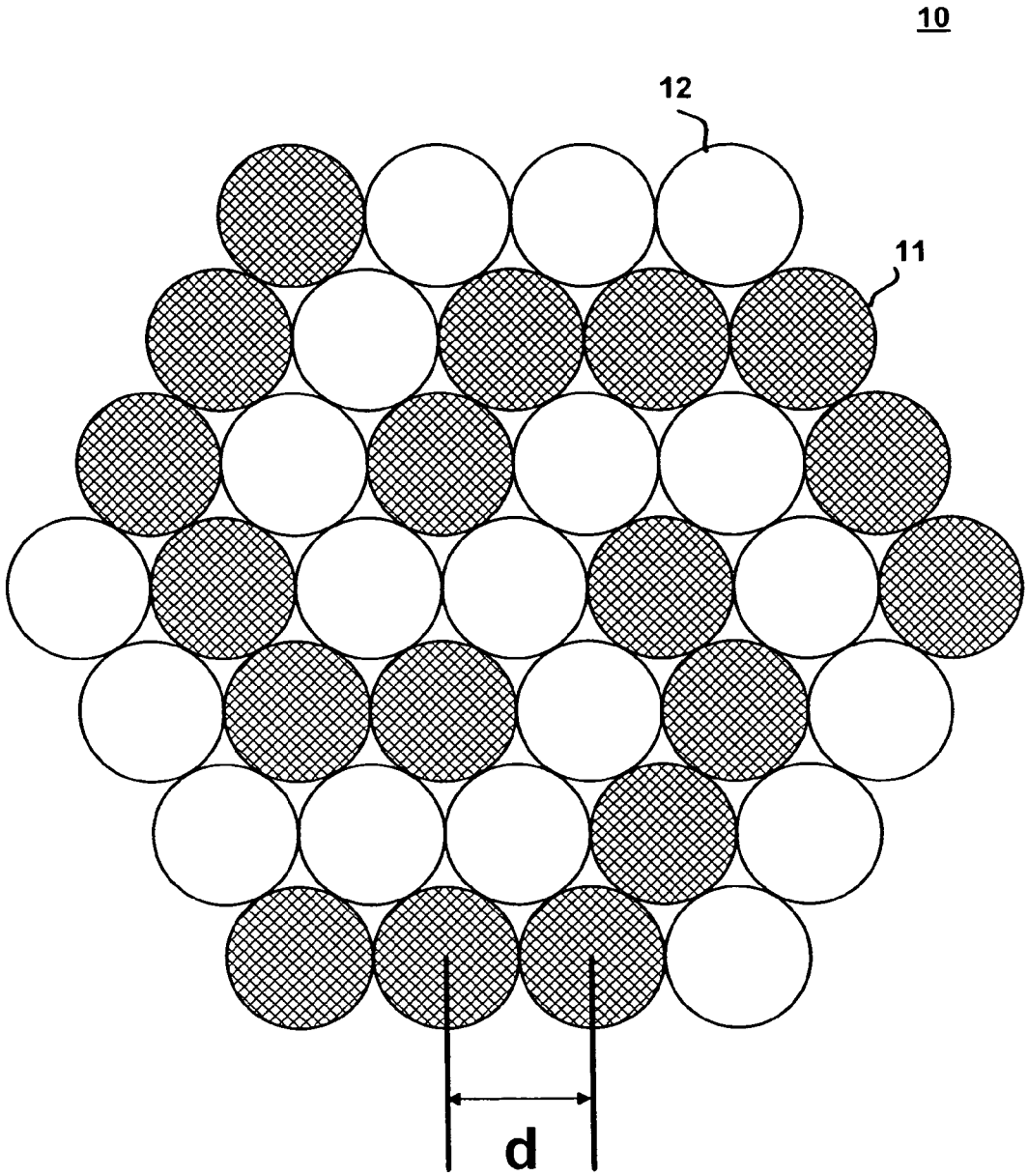
FIG. 1 is a diagram depicting a sparse trifilar array configuration according to one embodiment of the invention.

The invention will now be described more fully with reference to the accompanying drawings, wherein like reference numerals refer to like elements throughout the drawings. The following description includes preferred embodiments of the invention provided to describe the invention by way of example to those skilled in the art.

FIG. 1 is a diagram depicting an array antenna configuration according to one embodiment of the present invention. As shown in FIG. 1, array antenna 10 comprises eighteen antenna elements 11 which are depicted in the drawing as cross-hatched circles. Antenna elements 11 are arranged in three non-linear arrays, with each array comprising six antenna elements. The three arrays represent a trifilar configuration. The number and arrangement of antenna elements 11 depicted in FIG. 1 represents only one embodiment of the invention. Alternative embodiments of the invention may include more or less than eighteen antenna elements in the configuration with more or less than six elements in each of the three non-linear arrays.

Antenna elements 11 are approximately aligned to lattice positions of a lattice structure. According to a preferred embodiment of the invention, the lattice structure is a triangular lattice having a center-to-center spacing d. The triangular lattice structure is more space efficient than other lattice structures, such as a rectangular lattice. Vacant lattice positions 12 within array antenna 10 are depicted in FIG. 1 as empty circles. Because not all lattice positions are occupied by an antenna element, the configuration of array antenna 10 is considered a sparse array.

The antenna elements of each of the three non-linear arrays depicted in FIG. 1 occupy adjacent lattice positions. Specifically, each of antenna elements 11 occupies a lattice position within the array that is adjacent to at least one other antenna element that is part of the non-linear array. The antenna elements of each non-linear array are also separated from the antenna elements of the other two non-linear arrays by at least one vacant lattice position. This arrangement provides advantages over other sparse array designs. For example, positioning antenna elements next to other active antenna elements improves the performance of the antenna elements as a group. Additionally, this arrangement allows for a more efficient layout of a beam forming network behind the antenna elements.

Beam forming networks for feeding the individual antenna elements are well known. These networks typically include one or more amplifiers, filters, phase shifters, etc. The individual components and their respective operations are well known to those skilled in the art. Accordingly, a detailed description of the beam forming network has not been included in this specification.

The three non-linear arrays disrupt periodicity and symmetry in the array antenna. A periodic array produces an antenna pattern that is also periodic. The periodic equivalents of the primary antenna beam, also referred to as grating lobe patterns, will reduce the overall antenna gain of the array antenna if these grating lobe patterns enter real space. Grating lobe patterns also can cause other harmful effects such as interference. To remove or minimize grating lobes, the periodicity of array antenna 10 is interrupted by increasing the complexity of the array symmetry. Using three non-linear, or curved, arrays of antenna elements removes reflection symmetry from the arrangement. In a preferred embodiment, the three non-linear arrays are arranged in a common pattern. This arrangement creates the same curvature in each array and creates a three-fold rotational symmetry at 120 degrees and 240 degrees for the array antenna configuration.

The location of grating lobes is a function of the antenna element spacing and hence the lattice spacing d. As the size of d increases, the separation between the main antenna beam and the grating lobes decreases. If d is too large, the grating lobes may enter real space and degrade the performance of the array antenna. Accordingly, a preferred value of d keeps the grating lobes out of real space. This preferred value of d depends on the scan requirements of the array antenna. Typically, d is at least approximately one-half of the wavelength of the signal being transmitted.

The sparse trifilar configuration described above provides several advantages over conventional array antennas. One significant advantage is that a sparse array antenna configured as described above provides approximately the same directivity as a fully populated array while using about half the number of antenna elements. Accordingly, for a given aperture size, the present invention approximately maintains the performance of a fully populated array with the reduced costs and weight of a sparsely populated array antenna.

Antenna elements 11 can be implemented using any of a number of types of antenna elements known to those skilled in the art. In a preferred embodiment of the invention, antenna elements 11 are planar patch antennas designed for the particular frequency bands in which the array antenna is operating. Planar patch antennas also have a thin profile which reduces the overall thickness of the array antenna. Antenna elements 11 are depicted in FIG. 1 as being circular in shape. The circular shape is used in the drawings for purposes of description. It should be noted, however, that the invention is not limited to this shape of planar patch antenna and can be implemented using any shape of planar patch antenna without departing from the scope of the invention. It is further noted that different shapes and sizes of antenna elements will vary the spacing between adjacent antenna elements for a given center-to-center spacing.

Figure 2:
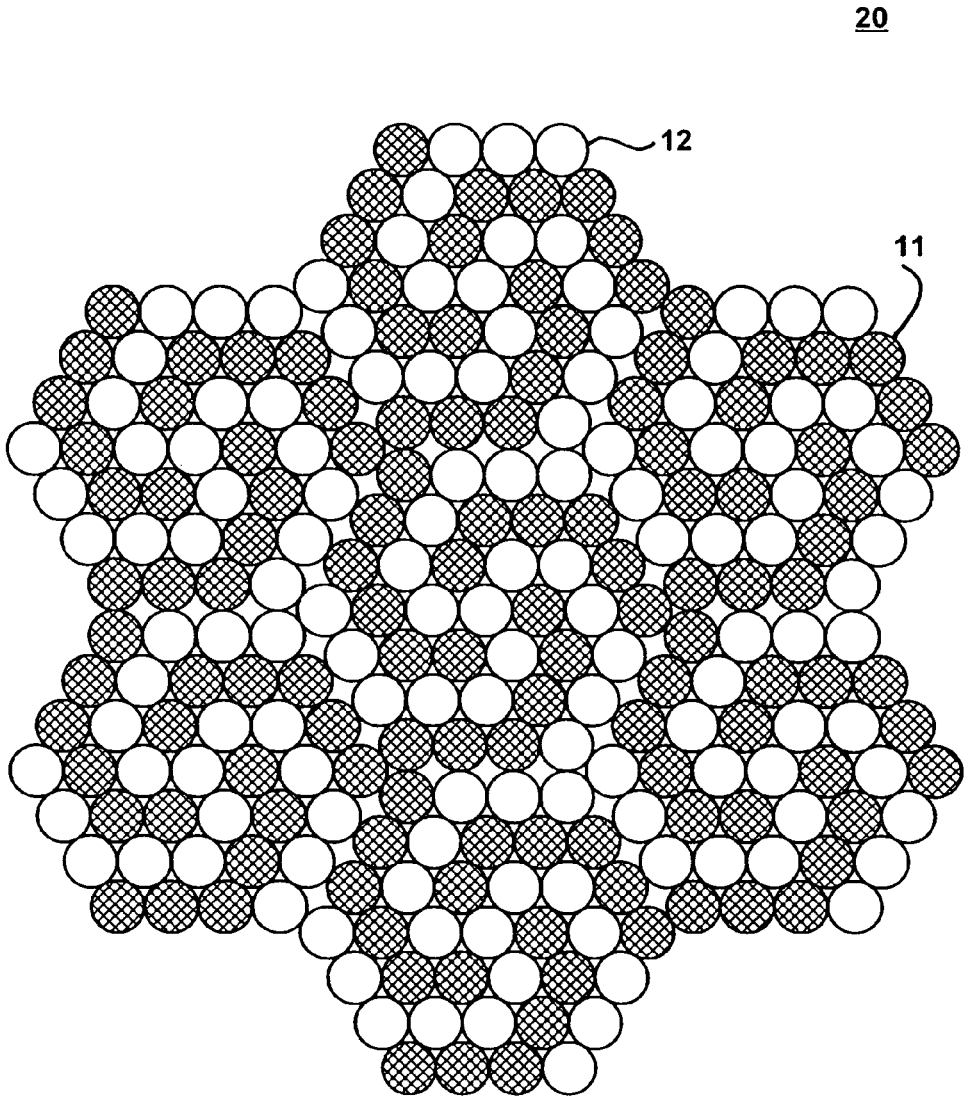
FIG. 2 is a diagram depicting an array antenna configuration formed using multiple sub-arrays according to one embodiment of the invention.

According to one embodiment of the invention, multiple instances of array antenna 10 are used as sub-arrays configured as a larger array antenna. FIG. 2 is a diagram depicting one such configuration of array antenna 20 comprising seven sub-arrays. Each sub-array includes eighteen antenna elements 11, which are depicted as cross-hatched circles. Vacant lattice positions 12 are depicted as empty circles. The innovative design of the present invention makes the configuration scalable to larger aperture sizes and/or different shapes and designs to accommodate particular system requirements. It is to be understood that the arrangement depicted in FIG. 2 is only one example of an array antenna formed using multiple sub-arrays. Alternative embodiments of the invention may include more or less than seven sub-arrays, and may have a different arrangement than that shown in FIG. 2.

Figure 3:
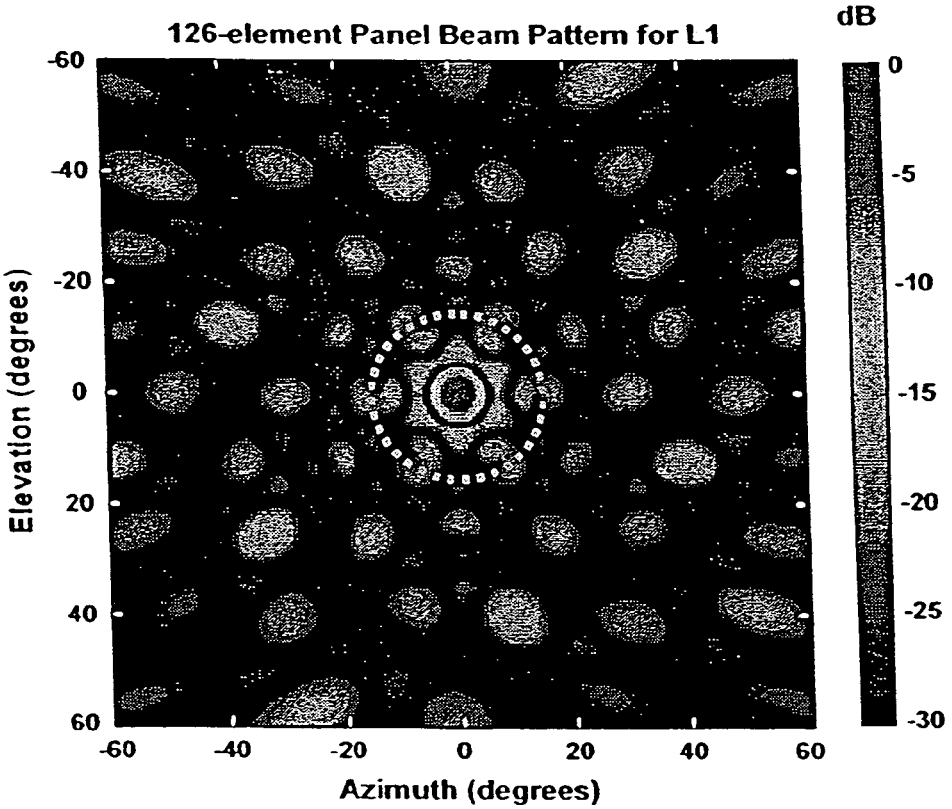
FIG. 3 is a computed radiation pattern for an array antenna configured according to one embodiment of the invention.

FIG. 3 is a computed radiation pattern for array antenna 20 depicted in FIG. 2. The radiation pattern was computed based on an element spacing d of 5.75 inches, or 0.767 wavelengths at a frequency of 1575.42 MHz. The sub-arrays used to form array antenna 20 are aligned so that the configuration of array antenna 20 has the same symmetry characteristics as the individual sub-arrays. Specifically, array antenna 20 has no reflection symmetry and has three-fold rotational symmetry at 120 degrees and 240 degrees. Generally, the radiation pattern of an array antenna will have symmetry close to that of the arrangement of antenna elements in the array antenna. This characteristic is shown in the radiation pattern depicted in FIG. 3, which also has no reflection symmetry and has three-fold rotational symmetry at 120 degrees and 240 degrees.

Figure 4:
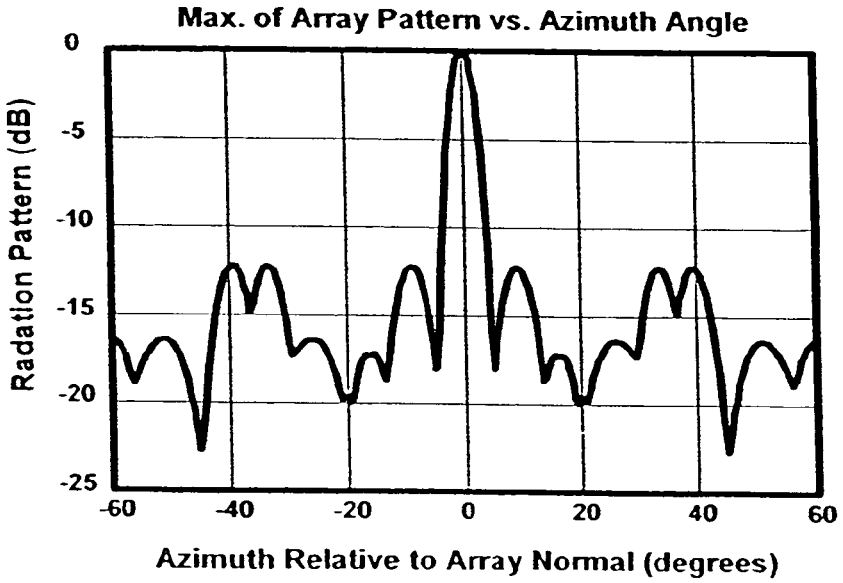
FIG. 4 is a graph showing the relative maxima of the radiation pattern shown in FIG. 3.

FIG. 4 is a graph depicting the relative maxima of the radiation pattern depicted in FIG. 3 as a function of the azimuth angle. As shown in FIG. 4, the radiation pattern has a main beam at array normal with side lobes having the largest magnitudes at 30 to 40 degrees from array normal. The magnitudes of these side lobes are approximately 12 dB below the magnitude of the main beam. It is noted that this magnitude is comparable to the −13 dB of the first side lobes generated by a conventional fully populated rectangular array antenna.

Figure 5:
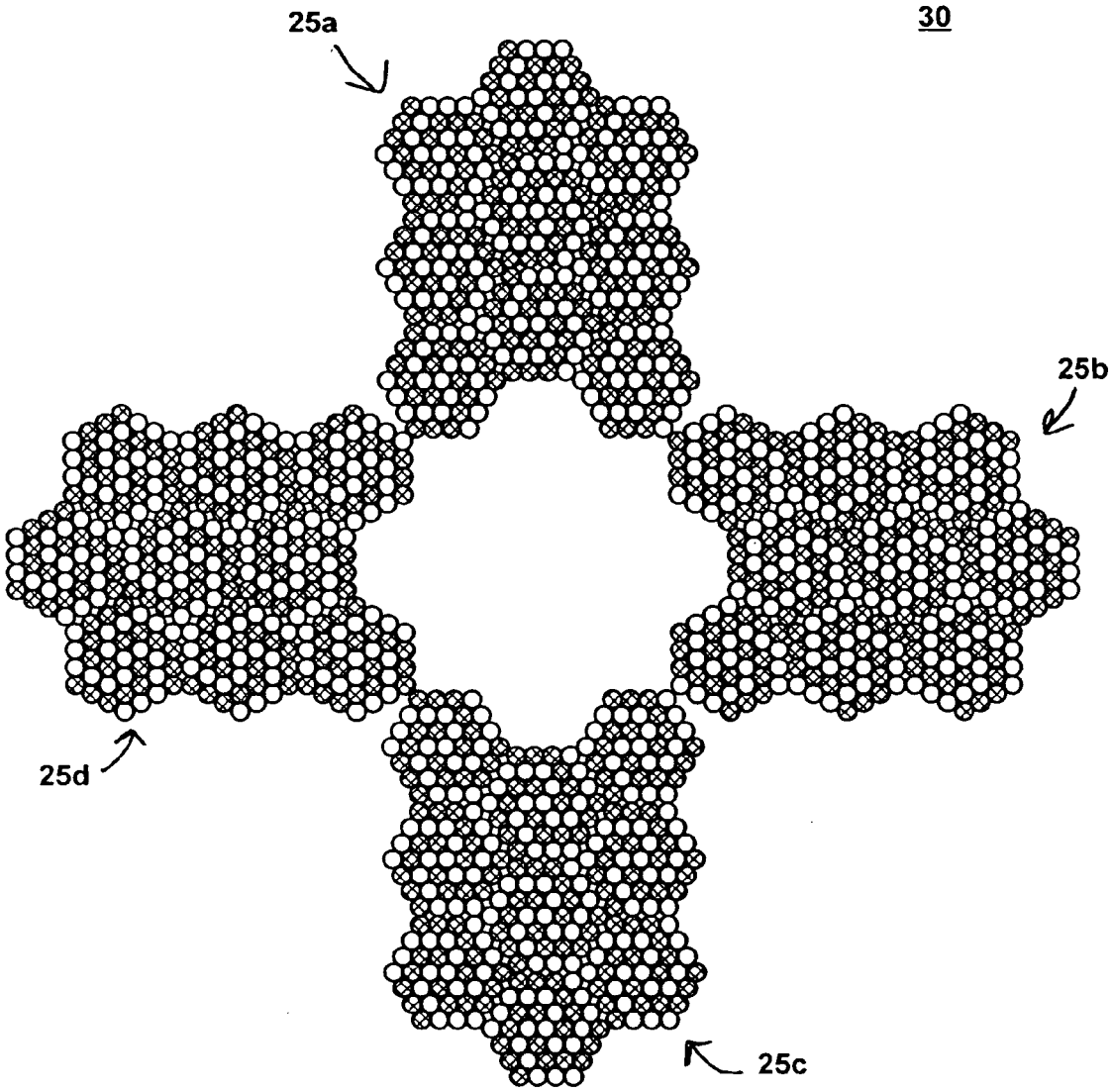
FIG. 5 is a diagram depicting an array antenna configuration formed using multiple sub-arrays according to one embodiment of the invention.

The complexity of the symmetry of an array antenna configured according to the present invention can be further increased by arranging a group of array antennas in a symmetric arrangement different from that of the individual array antennas. FIG. 5 depicts one configuration of an array antenna 30 comprising four array antennas 25*a* to 25*d* used as sub-arrays. Each of array antennas 25*a* to 25*d* include nine sub-arrays such as the one depicted in FIG. 1, and are individually identical except that they are arranged 90 degrees from each other, as shown in FIG. 5. Using this arrangement, the diversity in the symmetry of the overall array antenna 30 is increased. Specifically, array antenna 30 has a four-fold rotational symmetry at 90 degrees, 180 degrees and 270 degrees, which does not correspond to the three-fold rotational symmetry at 120 degrees and 240 degrees of the individual array antennas 25*a* to 25*d*. As a result, array antenna 30 has no reflection symmetry nor three-fold rotational symmetry.

It is to be understood that the configuration depicted in FIG. 5 represents only one embodiment of the invention. One skilled in the art will recognize other possible configurations within the scope of the invention. Alternative embodiments may also combine the array antennas of the present invention with array antennas of other designs. For example, a conventional array antenna may be placed in the open center of the configuration shown in FIG. 5. Alternatively, other components of a satellite system may be arranged in the open center of the configuration.

A common requirement for transmission array antennas is the ability to transmit two signals. The two signals may differ from each other in frequency, information content, and/or intended receiver. Conventional array antennas typically meet this requirement using a single antenna element designed to radiate both signals. However, when two signals have a common signal path, intermodulation products can introduce spurious signals into the system. The present invention addresses this concern by using an independent set of antenna elements arranged as an independent array antenna for each signal.

Figure 6:
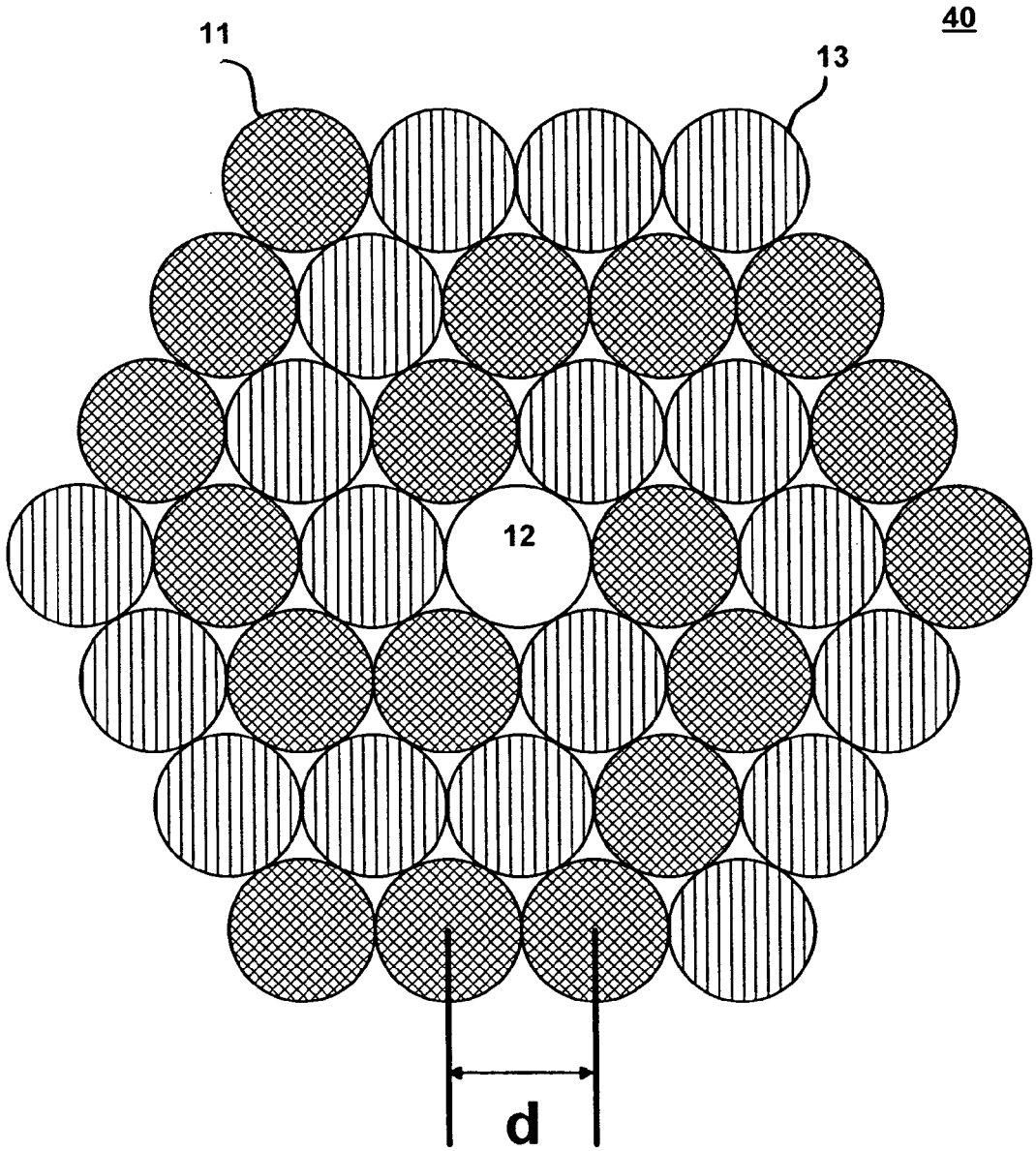
FIG. 6 is a diagram depicting an interleaved array antenna configuration according to one embodiment of the invention.

FIG. 6 is a diagram depicting a configuration of an array antenna having two independent sets of antenna elements according to one embodiment of the invention. As shown in FIG. 6, array antenna 40 includes a first group of eighteen antenna elements 11, represented by cross-hatched circles, and a second group of eighteen antenna elements 13, represented by striped circles. A single vacant lattice position 12 is represented by an empty circle. The first group of eighteen antenna elements 11 is arranged in three non-linear arrays in the manner described above with respect to FIG. 1. Likewise, the second group of eighteen antenna elements 13 is arranged in three non-linear arrays in the manner described above with respect to FIG. 1. The two sets of non-linear arrays are interleaved so that the non-linear arrays of one group occupy lattice positions between the non-linear arrays of the other group. In this manner, both sets of non-linear arrays occupy the same aperture. Additionally, the triangular lattice structure on which the antenna elements are positioned provides a more space efficient structure than other lattice structures such as a rectangular lattice.

The configuration depicted in FIG. 6 represents only one embodiment of the present invention. Alternative embodiments may include different numbers of antenna elements 11 and 13 configured into the two sets of non-linear arrays. For example, alternative embodiments may use more or less than eighteen antenna elements in the two groups of antenna elements, with more or less than six antenna elements in each of the non-linear arrays.

Antenna elements 11 and 13 can be implemented using any of a number of types of antenna elements known to those skilled in the art. In a preferred embodiment of the invention, antenna elements 11 and 13 are planar patch antennas designed for the frequency bands of the respective signals being transmitted. Alternative embodiments may use the same type of antenna element for antenna elements 11 and antenna elements 13 so long as the type of antenna element is capable of transmitting both signals. Antenna elements 11 and 13 may also be implemented using different types of antenna elements for each group. FIG. 6 depicts antenna elements 11 and 13 as being circular in shape. It is to be understood that the invention is not limited to this shape of planar patch antenna and can be implemented using any suitable shape of planar patch antenna known to those skilled in the art without departing from the scope of the invention. It is noted that different shapes and sizes of antenna elements will vary the spacing between adjacent antenna elements for a given center-to-center spacing.

When viewed individually, the configuration formed by antenna elements 11 and the configuration formed by antenna elements 13 are sparsely populated array antennas. As mentioned above, grating lobes are minimized or removed by disrupting the periodicity in the configuration of an array antenna. Periodicity of the array antenna is disrupted by increasing the complexity of the array symmetry. Arranging antenna elements 11 and 13 into two groups of three non-linear arrays removes reflection symmetry from the array configuration. As with the configuration shown in FIG. 1, each of the non-linear arrays has a common pattern in a preferred embodiment of the invention, which creates three-fold rotational symmetry at 120 degrees and 240 degrees for this configuration of an array antenna.

Similar to the configuration shown in FIG. 2, multiple instances of array antenna 30 can be used as sub-arrays in a larger array antenna. The innovative design of the present invention makes the configuration scalable to larger aperture sizes and/or different shapes and designs to accommodate particular system requirements. Again, it is to be understood that the arrangement shown in FIG. 2 is only one example of an arrangement of sub-arrays and that other arrangements can be used without departing from the scope of the invention. The symmetry of the larger array antenna can be disrupted further by arranging multiple instances of the larger array antenna in a symmetric arrangement different from that of the individual array antennas, as described above with respect to FIG. 5.

As described above, the interleaved configuration shown in FIG. 6 can be used to transmit two signals. The two signals may differ in frequency, information content and/or intended receiver (direction). One skilled in the art will recognize that an array antenna having this configuration can be used to transmit a first signal using one set of antenna elements while transmitting a second signal using the second set of antenna elements.

When transmitting two signals independently, conventional array antennas typically use a composite look-up table holding configuration parameters for controlling the beams for the antenna elements. For example, different configuration parameters are used to direct the respective beams in different directions. These configuration parameters generally require complicated calculations and are dependent upon the antenna beam configurations. The present invention allows each set of antenna elements, such as those shown in FIG. 6, to operate independently and thereby use independent look-up tables to obtain configuration parameters to obtain desired antenna beam configurations. These independent look-up tables typically are smaller in size and less complicated to generate than a composite look-up table used in conventional systems to transmit two signals independently.

One skilled in the art will recognize that the configuration shown in FIG. 6 can be used to transmit or receive multiple signals. For example, an array antenna having this configuration can be configured to receive a first signal using one set of antenna elements and a second signal using the other set of antenna elements. Alternatively, one set of antenna elements can be configured to receive a first signal while the other set of antenna elements is configured to transmit a second signal.

The invention described above has many advantages over conventional array antenna designs. Among the significant advantages, the array antenna of the present invention can be implemented in a lightweight, thin-profile design having low manufacturing costs. These advantages are achieved using relatively thin planar patch antennas as the antenna elements in the preferred embodiment of the invention. Additionally, the configuration of the antenna elements simplifies the complexity of the interconnections between antenna elements by arranging the antenna elements in each non-linear array adjacent to each other.

The foregoing description of the invention illustrates and describes the preferred embodiments of the present invention. However, it is to be understood that the invention is capable of use in various other combinations and modifications within the scope of the inventive concept as expressed herein, commensurate with the above teachings, and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the scope of the invention, which should be interpreted using the appended claims.

What is claimed is:

1. A trifilar array antenna, comprising a plurality of antenna elements arranged in three non-linear arrays, wherein the plurality of antenna elements are aligned to a lattice structure with the antenna elements of each non-linear array arranged in adjacent lattice positions, and wherein the three non-linear arrays are separated by vacant lattice positions.

2. The trifilar array antenna according to claim 1, wherein the plurality of antenna elements comprises planar patch antennas.

3. The trifilar array antenna according to claim 1, wherein the lattice structure is a triangular lattice.

4. The trifilar array antenna according to claim 1, wherein the arrangement of the plurality of antenna elements has no reflection symmetry.

5. The trifilar array antenna according to claim 1, wherein the three non-linear arrays have a common pattern.

6. The trifilar array antenna according to claim 1, wherein the arrangement of the plurality of antenna elements has three-fold rotational symmetry.

7. An array antenna, comprising a plurality of the trifilar array antennas according to claim 1.

8. A composite array antenna comprising a plurality of the array antennas according to claim 7, wherein the plurality of array antennas are arranged in a configuration having symmetry different from that of each of the plurality of the individual array antennas.

9. An array antenna, comprising:

a first plurality of antenna elements arranged in a first group of three non-linear arrays; and a second plurality of antenna elements arranged in a second group of three-non-linear arrays, wherein the first and second pluralities of antenna elements are aligned to a lattice structure with the antenna elements of each non-linear array arranged in adjacent lattice positions, and wherein the antenna elements of the first group of non-linear arrays occupy lattice positions between the antenna elements of the second group of non-linear arrays.

10. The array antenna according to claim 9, wherein the first and second pluralities of antenna elements comprise planar patch antennas.

11. The array antenna according to claim 9, wherein the first plurality of antenna elements comprises antenna elements of a first type, and the second plurality of antenna elements comprises antenna elements of a second type different from the first type.

12. The array antenna according to claim 11, wherein the first plurality of antenna elements operates at a first frequency and the second plurality of antenna elements operates at a second frequency different from the first frequency.

13. The array antenna according to claim 9, wherein one of the first and second pluralities of antenna elements is configurable to transmit a first signal while the other one of the first and second pluralities is configurable to transmit a second signal.

14. The array antenna according to claim 9, wherein the first plurality of antenna elements is configured to transmit a first signal in a first direction and the second plurality of antenna elements is configured to transmit a second signal in a second direction.

15. The array antenna according to claim 9, wherein one of the pluralities of antenna elements is configurable to transmit a first signal and the other one of the pluralities of antenna elements is configurable to receive a second signal.

16. The array antenna according to claim 9, wherein the lattice structure is a triangular lattice.

17. The array antenna according to claim 9, wherein the arrangement of the first and second pluralities of antenna elements has no reflection symmetry.

18. The array antenna according to claim 9, wherein the three non-linear arrays of the first group and the three non-linear arrays of the second group have a common pattern.

19. The array antenna according to claim 9, wherein the arrangement of the first and second pluralities of antenna elements has three-fold rotational symmetry.

20. The array antenna according to claim 9, wherein the first and second pluralities of antenna elements are each configured using parameters stored in independent look-up tables.

21. An array antenna, comprising a plurality of the array antennas according to claim 9.

22. A composite array antenna, comprising a plurality of the array antennas according to claim 21, wherein the plurality of array antennas are arranged in a configuration having a symmetry different from that of each of the plurality of the individual array antennas.

23. The composite array antenna according to claim 22, wherein the individual array antennas have a three-fold rotational symmetry and the composite array antenna has a four-fold rotational symmetry.

* * * * *

UNITED STATES PATENT AND TRADEMARK OFFICE

CERTIFICATE OF CORRECTION

PATENT NO. : 7,466,287 B1
APPLICATION NO. : 11/358044
DATED : December 16, 2008
INVENTOR(S) : Lawrence K. Lam et al.

It is certified that error appears in the above-identified patent and that said Letters Patent is hereby corrected as shown below:

In Column 7, Lines 55-56: Remove “individual”

In Column 8, Line 56: Remove “individual”

Signed and Sealed this

Seventeenth Day of March, 2009

JOHN DOLL
*Acting Director of the United States Patent and Trademark Office*